US005174860A

United States Patent [19]

van Heiningen et al.

[11] Patent Number: 5,174,860

[45] Date of Patent: Dec. 29, 1992

[54] LOW TEMPERATURE RECOVERY OF KRAFT BLACK LIQUOR

[76] Inventors: Adriaan R. P. van Heiningen, 79 Devon Road, Baie d'Urfe, Quebec, Canada, H9X 2X2; Jian Li, 1500 Stanley St., Apt. 928, Montreal, Quebec, Canada, H3A 1R3; John Fallavollita, 10474-28A Ave., Edmonton, Alberta, Canada, T6J 4J6

[21] Appl. No.: 433,604

[22] Filed: Nov. 8, 1989

[30] Foreign Application Priority Data

Nov. 17, 1988 [CA] Canada ..... 583409

[51] Int. Cl.[5] ..... D21C 11/00

[52] U.S. Cl. ..... 162/30.11; 162/38; 162/47

[58] Field of Search ..... 162/30.1, 30.11, 35, 162/38, 51, 47, 39; 423/DIG. 3

[56] References Cited

U.S. PATENT DOCUMENTS

| | | | |
|---|---|---|---|
| 1,906,886 | 5/1933 | Richter | 162/30.11 |
| 3,309,262 | 3/1967 | Copeland et al. | 162/30.1 |
| 3,322,492 | 7/1964 | Flood | 423/206 R |
| 3,414,038 | 12/1968 | Laakso | 162/47 |
| 3,523,864 | 8/1970 | Osterman et al. | 162/30.11 |
| 3,574,051 | 4/1971 | Shah | 162/30.11 |
| 4,242,177 | 12/1980 | Suzuki et al. | 162/51 |

FOREIGN PATENT DOCUMENTS

| | | | |
|---|---|---|---|
| 1089162 | 2/1976 | Canada | 9/36.2 |

OTHER PUBLICATIONS

Li et al., Kinetics of Sodium Sulfate in the Solid State by Carbon Monoxide, McGill University, pp. 2079–2085.

White et al., Manufacture of Sodium Sulfide, Industrial and Engineering Chemistry, vol. 28 No. 2, Feb. 1936, pp. 244–246.

*Primary Examiner*—Richard V. Fisher
*Assistant Examiner*—Charles K. Friedman

[57] ABSTRACT

A kraft black liquor recovery system utilizing three separate reactors for liquor pyrolysis, sulfate reduction and carbon plus organics combustion, respectively. Oxidized black liquor is pyrolyzed in a fluid bed reactor. The temperature in the fluid bed reactor is 600° C. or lower. The resulting char, containing $Na_2CO_3$ and $Na_2SO_4$ and a significant amount of carbon, is separated from the pyrolysis gases and introduced in an indirect heated reactor where reduction of $Na_2SO_4$ to $Na_2S$ takes place in the solid state under an atmosphere generated by the reduction. The reduced char is cooled and leached to produce green liquor. The leached char and gases from the pyrolysis and reduction reactors are burned in a fluid bed combustion unit operating below the melting point of mixtures of $Na_2CO_3$ and $Na_2SO_4$. The fluid bed particles, consisting mainly of $Na_2CO_3$ and $Na_2SO_4$, serve to remove the volatile oxidized sulfur species formed by combustion of the pyrolysis gas. The overflow of pellets are ground and dissolved in the incoming heavy black liquor feed.

20 Claims, 1 Drawing Sheet

LOW TEMPERATURE RECOVERY OF KRAFT BLACK LIQUOR

BACKGROUND OF THE INVENTION

1. Field of the Invention

The present invention relates to a pulp mill recovery system. More specifically, the present invention relates to a low temperature kraft spent liquor recovery system utilizing separate reactors for pyrolysis, combustion and sulfate reduction.

2. Description of the Prior Art

The central piece of equipment for recovery of cooking chemicals and energy from kraft black liquor is the so-called Tomlinson furnace. Black liquor at about 65% dry solids content is sprayed into the furnace. During their descent, the black liquor droplets lose the remaining water by evaporation and the solids pyrolyze to form a char bed at the bottom of the furnace. The char bed burns under reducing conditions at a temperature of about 750°-1050° C. and the recovered chemicals, mainly $Na_2CO_3$ and $Na_2S$, are drained from the furnace as a smelt. The smelt is dissolved in water to produce so-called green liquor, the precursor of the cooking liquor called white liquor. The gases generated during pyrolysis and burning of the char are fully combusted at a higher location in the furnace. The furnace is provided with suitable heat exchange means to recover heat from the hot combustion gases for steam and electricity generation.

Although the objective of the recovery of chemicals and energy is adequately achieved in present commercial operations, the use of the Tomlinson furnace presents a number of problems. For example, inadvertant contact between water and the inorganic smelt has resulted in serious explosions. Also, high char bed temperatures lead to increasing emission of sodium salts and excessive fouling of the steam pipes in the upper part of the furnace.

To solve these problems, and also to reduce capital investment and increase the energy efficiency of the recovery operation, a number of kraft recovery alternatives have been described. In some of these alternatives the smelt-water explosion hazard is eliminated and the emission of sodium salts reduced by keeping the inorganic chemicals in solid rather than molten form. This principle was used by Copeland et al., U.S. Pat. No. 3,309,262, where spent liquor is concentrated and introduced by atomization into a fluidized bed reactor. The resulting waste liquor spray encounters residual inorganic chemicals derived from the combustion of previous spent liquors. Additionally, the fluidized bed reactor may contain inert materials such as silica grains in admixture with the inorganic chemicals. In the fluidized bed reactor, operated with excess air, all the organic material is combusted below the fusion point of the inorganic salt mixture. The sodium sulfate in the inorganic pellets are reduced with hydrogen in a second fluidized bed (Arnold, Can. Pat. 828,654). Alternatively, the first fluid bed can be used as a means to provide incremental recovery capacity, while the reduction of sodium sulfate is achieved by injecting the pellets into the conventional recovery furnace (Tomlinson II, U.S. Pat. No. 4,011,129).

Flood, U.S. Pat. No. 3,322,492, describes a two-stage fluid bed process where weak black liquor at about 20% solids content is dried to solid granules in the first bed at a temperature of about 175° C. The sodium sulfate in the granules is reduced to sodium sulfide by virtue of carbon monoxide derived from decomposition of the organic matter in the second bed. The operating temperature of the second fluid bed is about 800° C.

Osterman, U.S. Pat. No. 3,523,864, presents a three-zone fluid bed reactor which would replace the conventional chemical recovery furnace and lime kiln. Black liquor is dried and burned under reducing conditions at about 650°-700° C. in the intermediate zone. The reducing gas from the intermediate zone is burned and serves as fluidizing medium for the top fluidized bed. Here predried $CaCO_3$ is introduced to be calcined to CaO pellets. These CaO pellets overflow first to the intermediate zone and then subsequently to the lower bed with a coating of mainly char, $Na_2SO_4$ and $Na_2CO_3$ from the burned black liquor. The reduction of $Na_2SO_4$ is said to take place in the lower fluidized bed at about 700°-760° C. with air and/or combustion gases as a fluidizing medium.

In the process of Shah, U.S. Pat. No. 3,574,051, kraft black liquor is concentrated by contact with a stream of heated air. The resulting concentrated black liquor is then burned with excess air in a fluidized bed reactor while the bed temperature is maintained at about 250°-600° C. The solid salts are then passed through another reactor and subjected to a reducing gas stream containing mainly carbon monoxide. It is claimed that in the range of 250°-500° C. the sodium sulfate is reduced to sodium sulfide. Green liquor is produced by dissolution of the salts in water.

Lange, Can. patent 1,089,162, presents a low temperature process where the organic portion of black liquor is gasified in a fluidized bed, operating not in excess of 760° C. so as to keep the inorganic portion of black liquor in the solid state. The solid particles leaving the bed will typically contain 90% $Na_2CO_3$, 9% $Na_2S$, less than 1% $Na_2SO_4$, and less than 1% carbon. After dissolving the solids in water, and separation of the carbon, the liquor will be used to remove $H_2S$ from the gas produced in the fluidized bed reactor. The spent absorbing medium can then be treated to form the cooking liquor which is returned to the digestion process.

In all the above alternatives to the conventional kraft recovery process (except for the process of Tomlinson II, U.S. Pat. No. 4,011,129), $Na_2S$ and $Na_2CO_3$ are produced from black liquor in reactors operating below the fusion point of the inorganic salt mixture. As far as is known, only the Copeland process is used on a commercial scale. However, in this process the end products are pellets consisting of mainly $Na_2SO_4$ and $Na_2CO_3$ rather than mainly $Na_2S$ and $Na_2CO_3$. There are two main reasons for the absence of commercial utilization of these low temperature processes. First, the relatively high temperature required for fast and complete conversion of $Na_2SO_4$ to $Na_2S$ and, secondly, the ease of formation of $H_2S$ when $Na_2S$ is contacted with combustion gases below the melting point of the inorganic salts. So, while the reduction is favored by a high temperature, the above alternative processes require a relatively low temperature just below the melting point of the inorganic salt mixture. The consequence is that in fluid bed processes operating in the reducing mode, most of the formed $Na_2S$ is rapidly converted to $H_2S$ (and some COS) according to the overall reaction $$Na_2S + CO_2 + H_2O \rightarrow Na_2CO_3 + H_2S$$

resulting in a low yield of solid $Na_2S$.

It is an object of this invention to provide a kraft recovery process whereby $Na_2CO_3$ and $Na_2S$ are formed below the melting point of the inorganic pulping chemicals with a minimum production of sulfurous gases.

It is a further object of this invention to provide an assembly for carrying out the process, more especially an assembly of reactors.

SUMMARY OF THE INVENTION

The process of the invention provides for the recovery of energy and kraft pulping chemicals in a system of multiple reactors, all operating below the melting point of the mixture of inorganic pulping chemicals.

In accordance with one aspect of the invention there is provided a process for the treatment of kraft black liquor which comprises i) pyrolyzing black liquor which contains inorganic salts, including an oxysulphur component and a carbonate component, at a temperature of not more than 600° C. to produce a char; ii) subjecting the char to reducing conditions effective to reduce the oxysulphur component to a sulphide salt component inside the char; the reduction is carried out at a temperature above 600° C. and below the melting temperature of the salts in the char in an atmosphere generated by the reduction itself; iii) cooling the resulting char; iv) leaching the cooled resulting char from iii) with an aqueous leaching liquid to leach inorganic salts from the char; and v) recovering the aqueous liquid bearing the salts from iv) as a green liquor.

In a particular embodiment of the process volatile components from the pyrolysis and reduction stages, for example pyrolysis gases, are combusted in a fluid bed reactor and the heat energy of combustion is recovered. The leached char may also be passed to the fluid bed reactor.

In another aspect of the invention there is provided an apparatus for the treatment of kraft black liquor which comprises a pyrolyzer, a reduction reactor, a char leacher and a fluid bed combustor for carrying out the several stages of the process of the invention. Flow lines are provided between the several parts of the apparatus, in particular a first line between the pyrolyzer and the reduction reactor, a second line between the reduction reactor and the char leacher, a third line for green liquor from the char leacher, a fourth line from the pyrolyzer to the fluid bed combustor, and a fifth line from the reduction reactor to the fluid bed combustor.

The inorganic salts are in particular sodium salts, especially sodium carbonate and sodium salts of oxysulphur acids, for example sodium sulphate, sulphite and thiosulphate.

Thus in a particular embodiment the present invention employs a fluidized bed pyrolyzer where black liquor at 30–100% dry solids, but preferably 60–100% dry solids, is pyrolized with hot combustion gases and some air. It is preferred that the black liquor is previously oxidized. Air is premixed with the combustion gases and used for temperature control. The temperature of the solids in the reactor is 600° C. or lower. This minimizes the formation of $Na_2S$ and subsequent formation of sulfurous gases from the decomposition of $Na_2S$. The resulting char, containing $Na_2CO_3$ and $Na_2SO_4$ but mostly free of $Na_2S$, is separated from the pyrolysis gases and introduced in a reactor where reduction of $Na_2SO_4$ to $Na_2S$ takes place under an atmosphere generated by the reduction itself. The low partial pressures of $H_2O$ and $CO_2$, the presence of carbon, and a temperature above 600° C. but preferably slightly below the onset of smelt formation, favor conversion of $Na_2SO_4$ to $Na_2S$ with minimum production of $H_2S$ or other sulfur containing gases. The char leaving this reduction reactor is cooled and contacted with water to produce green liquor and leached char. The leached char and gases from the pyrolysis and reduction reactors are burned in a fluid bed combustion unit operating below the melting point of the mixture of $Na_2CO_3$ and $Na_2SO_4$. The fluid bed pellets, consisting mainly of $Na_2CO_3$ and $Na_2SO_4$, serve to remove the gaseous oxidized sulfur species formed by combustion of the sulfurous components produced in the reduction and pyrolysis reactor. The overflow of pellets is ground and mixed with the black liquor feed. Alternatively, the leached char could be combusted in a typical coal fired furnace. In this case, flue gas cleaning equipment must be added to minimize sulfur emission.

DETAILED DESCRIPTION OF THE INVENTION

Figure 1:
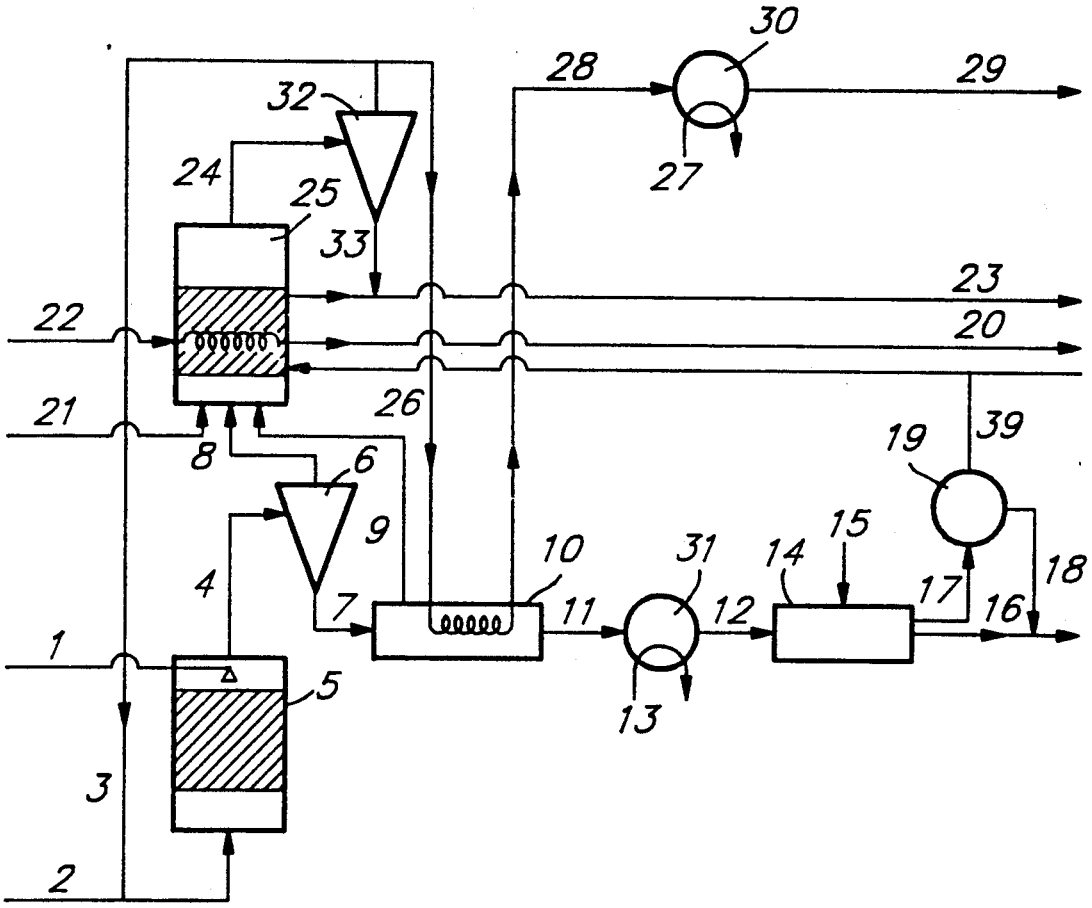
FIG. 1 is a schematic representation of a recovery process for kraft black liquor of the invention.

FIG. 1 is a schematic illustration of one form of the present invention. As shown in FIG. 1, the present invention includes as main pieces of equipment the fluid bed pyrolyzer 5, the indirect heated reducer 10, the char leacher 14, and the fluid bed combustor 25. Strongly oxidized black liquor is fed via line 1 to the fluid bed pyrolyzer and sprayed onto the fluid bed particles. The fluid bed particles are either black liquor char pellets or inert particles like sand or $Al_2O_3$ coated with black liquor char. The black liquor may contain 30–100% solids and, in the case of high dry solids content, the black liquor solids are injected under the surface of the fluidized bed with a carrier gas. The carrier gas can be air and/or cooled combustion gas. Air in line 2, mixed with combustion gas in line 3 from the fluid bed combustor 25 is used as a fluidizing medium in the fluid bed pyrolyzer 5. The temperature in pyrolyzer 5 is controlled by air flow rate in line 2 and the temperature of the combustion gases in line 3. Additionally, the pyrolyzer can be indirectly cooled or heated to obtain the required fluid bed temperature. The temperature of the fluid bed pyrolyzer is kept below about 600° C. to minimize formation of $Na_2S$ and subsequent formation of sulfurous gases from the decomposition of $Na_2S$. The flue gases leaving the pyrolyzer 5 via line 4 also contain high boiling point organic compounds and elutriated black liquor char particles. The particles are separated from the gas in cyclone 6 operating at essentially the same temperature as the fluid bed pyrolyzer 5. The char is transported by gravity or mechanical means via line 7 to reduction reactor 10. Alternatively, the char pellets may be removed directly from the fluid bed and transported to the reduction reactor. Reactor 10 is indirectly heated by the flue gases in line 26 from the fluid bed combustor 25 or heated by other means. The temperature in the reduction reactor is about 750° C., i.e. slightly below the value where the onset of smelt formation occurs. A relative motion between the char and internal surface of reactor 10 is maintained by either internal mechanical agitation or rotation/oscillation of the reactor 10 itself. The gases produced in reactor 10 are vented via line 9 to the fluid bed combustor 25. The admission of gases which contain $CO_2$ or $H_2O$ to reactor 10 should be minimized to reduce the formation of sulfurous gases from $Na_2S$. The addition of CO to reactor 10 on the other hand is favorable for suppression of sodium emission from reactor 10. Thus the gas in reactor 10 is, preferably, high in CO content and low in $H_2O$ and $CO_2$ content. The char leaving the reduction reactor 10 contains mainly $Na_2CO_3$ and $Na_2S$ as the inorganic salts. The char is fed via line 11 to a steam producing heat exchanger 31, and subsequently to the char leacher 14 via line 12. Water is added via line 15 to remove, to a large extent, the inorganic salts from the char. The extracted char is separated from the resulting green liquor and enters a filter press 19 via line 17. In the filter press additional green liquor is removed from the char and combined with main green liquor streams in line 16. The leached and dewatered char is transported via line 39 to the fluid bed combustor 25. The particles in the fluid bed combustor consist mainly of $Na_2CO_3$ and $Na_2SO_4$ originating from $Na_2CO_3$ and $Na_2S$ remaining in the char after the filter press 19. Air enters reactor 25 and is mixed with the gas streams 8 and 9. The energy, generated by combustion of carbon, volatile organics, CO and $H_2$ in the fluid bed reactor 25 is used to generate steam leaving via line 20. The combustion products of sulfurous gases combine with $Na_2CO_3$ to form $Na_2SO_4$. The overflow of particles from the fluid bed combustor 25 are ground and mixed with heavy black liquor to be reintroduced in the present process. Part of the combustion gases from reactor 25 are recycled to reactor 5 and a part is vented to atmosphere after particulate removal in cyclone 32 and heat exchange in reactor 10 and heat exchanger 30. Alternatively, the leached and dewatered char in line 39 could be combusted in a typical coal fired furnace. In this case, flue gas cleaning might be added to minimize the emission of sulfur and sodium containing species. Finally, in order to increase the throughput through the reactors 5, 10 and 25, the gas pressure in the reactors can be increased to levels considerably above atmosperic.

EXAMPLE 1

Black liquor was obtained by cooking black spruce chips at 170° C. with white liquor at a liquor-to-wood ratio of 4 L/kg o.d. chips. The heat-up time from 80° to 170° C. was 90 minutes and the time at 170° C. was 45 minutes. The white liquor had a sulfidity of 29.82% and an effective alkali concentration of 30.07 g/L. After completion of the cook, the cooking liquor was blown from the digester and separated from the chips. The kappa number of the chips was 104. The black liquor was subsequently strongly oxidized in a continuously stirred batch pressurized reactor operating at 130° C., by bubbling air through the liquor for 180 minutes. Some of the liquor was then transferred to an $Al_2O_3$ dish and dried under I.R. lamps for 7 hours. The dried black liquor solids were put in an $Al_2O_3$ boat which was subsequently inserted in the quartz tube of a tube furnace preheated to 600° C. The volatiles produced during pyrolysis of black liquor solids were removed by a flow of 0.55 L/min (at room temperature) of 90% helium and 10% CO. The boat was removed from the furnace after 30 minutes at 600° C. Samples were taken for analysis and the boat was reintroduced in the tube furnace which was now increased in temperature to 750° C. The flow of 90% helium and 10% CO was maintained at 0.55 L/min. After 45 or 60 minutes at 750° C., the boat was again removed from the furnace and the black liquor char was analyzed for total sulfur, sulfide, oxy-sulfur and carbonate ion content. The analysis of the black liquor solids, the 600° C. pyrolyzed char and the char treated at 750° C. are shown for the two samples in Tables 1 and 2 respectively. The difference between the treatment conditions of the samples is the reduction time at 750° C. Also included are the yield and the sulfur loss for each treatment as well as the reduction efficiency after treatment at 600° C. and 750° C. The reduction efficiency is defined as $$\frac{\text{weight of } Na_2S \text{ (g)}}{\text{weight of } Na_2SO_4 \text{ (g)}} \times 100\%$$

The different ion contents were determined by ion chromatography of the solution obtained by leaching the solids or char. The total sulfur content was determined by the Schdniger combustion method and subsequent ion chromatographic analysis of the produced $SO^{-2}{}_4$. The percentages of total sulfur and all the anions are based on the original weight of the black liquor solids.

The results in Tables 1 and 2 show that the reduction efficiencies after pyrolysis at 600° C. are low, 8.6 and 8.3% for samples 1 and 2 respectively. However after treatment at 750° C. the reduction efficiencies increase to 87 and 83.8% respectively. It should be noted that the sulfur in the form of $S^{2-}$ and $SO^{2-}{}_4$ after pyrolysis at 600° C. accounts for 90.7 and 98.5% of the total sulfur in samples 1 and 2 respectively. Also after further treatment at 750° C., the amount of sulfur as $S^{2-}$ and $SO^{2-}{}_4$ is relatively unchanged at 88.9 and 97.6% respectively of the total sulfur. Finally the total sulfur loss during pyrolysis and reduction are 24.3 and 6.8% for samples 1 and 2 respectively.

TABLE 1

Pyrolysis and reduction of oxidized black liquor solids. (Sample 1)

| | Black liquor solids | Black liquor solids pyrolyzed at 600° C.* | Black liquor char treated at 750° C. for 60 minutes* |
|---|---|---|---|
| Initial weight (g) | — | 0.1817 | 0.2004 |
| Total S (%) | 2.80 | 2.12 | 2.13 |
| $SO_4^{2-}$ (%) | 4.96 | 4.93 | 0.43 |
| $SO_3^{2-}$ (%) | 0.37 | <0.1 | <0.1 |
| $S_2O_3^{2-}$ (%) | <0.05 | <0.05 | <0.05 |
| $S^{2-}$ (%) | <0.1 | 0.28 | 1.75 |
| $CO_3^{2-}$ (%) | 15.4 | 23.3 | 21.0 |
| yield (%) | — | 74.1 | 89.6 |
| Sulfur loss (%) | — | 24.3 | 0.0 |
| Reduction efficiency (%) | <3.2 | 8.6 | 87.0 |

*Total sulfur and anion percentages are based on the weight of the original black liquor solids.

TABLE 2

Pyrolysis and reduction of oxidized black liquor solids. (Sample 2)

| | Black liquor solids | Black liquor solids pyrolyzed at 600° C.* | Black liquor char treated at 750° C. for 45 minutes* |
|---|---|---|---|
| Initial weight (g) | — | 0.2241 | 0.1261 |
| Total S (%) | 2.76 | 2.02 | 1.96 |
| $SO_4^{2-}$ (%) | 5.30 | 5.13 | 0.55 |
| $SO_3^{2-}$ (%) | 0.1 | 0.1 | <0.1 |
| $S_2O_3^{2-}$ (%) | <0.05 | <0.05 | <0.05 |
| $S^{2-}$ (%) | <0.1 | 0.28 | 1.73 |
| yield (%) | — | 74.9 | 87.0 |
| Sulfur loss (%) | — | 26.8 | 3.0 |
| Reduction | <3.0 | 8.3 | 83.8 |

TABLE 2-continued

| Pyrolysis and reduction of oxidized black liquor solids. (Sample 2) | | | |
|---|---|---|---|
| | Black liquor solids | Black liquor solids pyrolyzed at 600° C.* | Black liquor char treated at 750° C. for 45 minutes* |
| efficiency (%) | | | |

*Total sulfur and anion percentages are based on the weight of the original black liquor solids.

TABLE 3

| Pyrolysis and reduction of non-oxidized black liquor solids. | | | |
|---|---|---|---|
| | Black liquor solids | Black liquor solids pyrolyzed at 600° C.* | Black liquor char treated at 750° C. for 60 minutes* |
| Initial weight (g) | — | 0.2971 | 0.1356 |
| Total S (%) | 2.37 | 1.30 | 1.16 |
| $SO_4^{2-}$ (%) | 0.27 | 0.47 | 0.56 |
| $SO_3^{2-}$ (%) | 2.78 | <0.1 | <0.1 |
| $S_2O_3^{2-}$ (%) | <0.1 | <0.16 | <0.1 |
| $S^{2-}$ (%) | <0.1 | 0.40 | 0.46 |
| $CO_3^{2-}$ (%) | 12.8 | — | 8.6 |
| yield (%) | — | 74.6 | 91.3 |
| Sulfur loss (%) | — | 45.0 | 11.0 |
| Reduction efficiency (%) | — | 58.0 | 58.0 |

*Total sulfur and anion percentages are based on the weight of the original black liquor solids.

EXAMPLE 2

In this example the same black liquor as described in Example 1 was used except that the oxidation in the continuously stirred reactor was deleted. Again the dried black liquor solids were pyrolyzed at 600° C. under helium and 10% carbon monoxide and subsequently exposed at 750° C. to the same gas mixture. The analysis of the black liquor solids, the 600° C. pyrolyzed char and the char treated at 750° C. are shown in Table 3. The analysis shows that the main inorganic sulfur containing species in black liquor solids is $SO^{2-}{}_3$, contrary to Example 1 where $SO^{2-}{}_4$ is the dominant ion. Subsequent pyrolysis at 600° C. gives a slightly higher sulfide content for the non-oxidized sample compared to the oxidized samples in Example 1. However the 45% sulfur loss is considerably larger than in Example 1. Further treatment of the non-oxidized sample at 750° C. increases the total sulfur-loss to 56%, while the reduction efficiency is unchanged at 58%. Thus from comparison of Examples 1 and 2 it is clear that a strongly oxidized black liquor is preferred in order to minimize the sulfur-loss and maximize the reduction efficiency.

EXAMPLE 3

About 10 mg of oxidized black liquor solids were pyrolyzed in a thermobalance by linearly increasing the temperature from 20° to 750° C. at a rate of 20° C./minute. The gas atmosphere was pure nitrogen up to 550° C. and 88% $N_2$ plus 12% CO above 550° C. After stabilization of the temperature at 750° C., $CO_2$ is added to a concentration of 20%, with the remaining gas being 10% CO and 70% $N_2$. The addition of $CO_2$ leads to gasification of the carbon in black liquor char as indicated by the recorded weight-loss and CO production. The composition of black liquor char during gasification is shown in Table 4. The results in Table 4 show a continuous decrease in inorganic sulfur content, while the reduction efficiency is maintained at 80–90%. COS was measured gas chromatographically as the only sulfur gas produced during gasification. The reaction responsible for the sulfur-loss is $$Na_2S + 2CO_2 \rightarrow COS + Na_2CO_3$$

The high $S_2O^{2-}{}_3$ content is due to rapid oxidation of $S^{2-}$ in aqueous solution before analysis of the water leachate of black liquor char by ion chromatography. The small sample size and the presence of carbon makes it extremely difficult to prevent the oxidation. It should also be noted that $Na_2S_2O_3$ cannot exist at 750° C. Combining this result with the preceding examples, it can be concluded that gasification leads to gaseous sulfur emission due to reaction between $Na_2S$ and $CO_2$ (and/or $H_2O$ vapor).

TABLE 4

| Composition of sulfur species in black liquor char during $CO_2$ gasification. | | | | | |
|---|---|---|---|---|---|
| Gasification time (min) | Carbon burn-off (%) | $S^{2-}$ (% wt)* | $SO_4^{2-}$ (% wt)* | $S_2O_3^{2-}$ (% wt)* | Reduction efficiency (%) |
| 0 | 0 | 0.96 | 0.17 | 0.7 | 90 |
| 4 | 25 | 0.5 | 0.13 | 0.5 | 86 |
| 9.5 | 50 | 0.7 | 0.13 | 0.4 | 90 |
| 16 | 75 | 0.3 | 0.13 | 0.6 | 80 |
| 36 | 100 | 0.4 | 0.10 | 0.4 | 87 |

Conditions:
1) Temperature 750° C.
2) CO concentration 10%
3) $CO_2$ concentration 20%
*Based on the weight of dry black liquor solids.

EXAMPLE 4

About 10 mg of oxidized black liquor char solids were pyrolyzed in a thermobalance under an atmosphere of pure helium by linearly increasing the temperature from 20° C. at a rate of 20° C./minute. The sample was kept at a final pyrolysis temperature until no further weight-loss occurred. The composition of the pyrolysis residue for different final pyrolysis temperatures is listed in Table 5. The table shows that no sulfur is lost under an inert atmosphere, and that high reduction efficiencies are achieved. It should also be noticed that a considerable loss of $Na_2CO_3$ occurs at higher pyrolysis temperatures in an inert atmosphere.

TABLE 5

| Composition of char after pyrolysis in helium. | | | | | | | |
|---|---|---|---|---|---|---|---|
| T (°C.) | $S_{total}$ (%) | $S^{2-}$ (%) | $S_4^{2-}$ (%) | $S_3^{2-}$ (%) | $S_2O_3^{2-}$ (%) | $Na^+$ (%) | $CO_3^{2-}$ (%) |
| b.l. solids | 3.1 | — | 1.2 | 3.6 | — | 19.5 | 10.5 |
| 675 | 2.3 | 1.8 | 0.9 | <0.1 | <0.05 | 18.1 | 17.9 |
| 775 | 2.3 | 2.0 | 0.3 | <0.1 | <0.05 | 5.73 | 2.96 |
| 800 | 2.4 | 2.2 | 0.2 | 0.2 | <0.05 | — | — |

1) Pyrolysis in helium until negligible weight-loss.
2) Percentages given are based on original weight of black liquor solids.

TABLE 6

| Composition of char after pyrolysis in 88% He and 12% CO for 30 minutes at $T_{final}$. | | | | | | | |
|---|---|---|---|---|---|---|---|
| $T_{final}$ (°C.) | $S_{total}$ (%) | $S^{2-}$ (%) | $S_4^{2-}$ (%) | $S_3^{2-}$ (%) | $S_2O_3^{2-}$ (%) | $Na^+$ (%) | $CO_3^{2-}$ (%) |
| b.l. solids | 3.1 | — | 1.2 | 3.6 | — | 19.5 | 10.5 |
| 750 | 2.4 | 1.7 | 1.1 | 0.1 | 0.2 | 17.6 | 15.5 |
| 800 | 2.4 | 2.2 | 0.1 | <0.1 | 0.1 | 17.7 | 10.6 |

EXAMPLE 5

About 10 mg of oxidized black liquor solids were pyrolyzed in a thermobalance under an atmosphere of 88% helium and 12% carbon monoxide. The temperature of the oven was linearly increased from 20° C. to a final temperature at a rate of 20° C./minute. The composition of the pyrolysis residue after being kept at the final pyrolysis temperature for 30 minutes is seen in Table 6. The results listed in Table 6 show that contrary to Table 5, no significant amount of sodium is lost at the higher pyrolysis temperatures when CO is present besides helium. Again no sulfur is lost at the higher pyrolysis temperatures. This shows that sodium emission can be suppressed by the presence of CO in the pyrolysis atmosphere.

We claim:

1. A process for the treatment of kraft black liquor comprising:

i) pyrolyzing kraft black liquor containing inorganic salts, said salts including an oxysulphur component and a carbonate component, at a temperature of not more than 600° C. to produce a char containing carbon and said inorganic salts with minimal conversion of the oxysulphur component to sulphide, ii) reducing said oxysulphur component of said char to a sulphide salt component with said carbon of said char inside the char, in an atmosphere generated by the reduction, at a temperature above 600° C. and below the melting temperature of said salts in said char, said atmosphere favoring conversion to a sulphide with minimum production of hydrogen sulphide of other sulphur containing gases in said char at said temperature above 600° C. and below the melting temperature of said salts in said char, iii) cooling the char from ii), iv) leaching the cooled char from iii) with an aqueous leaching liquid to leach inorganic salts comprising carbonates and sulphides therefrom, and v) recovering the aqueous liquid bearing said salts from iv) as a green liquor.

2. A process according to claim 1 wherein said inorganic salts in i) comprise sodium salts and said green liquor in v) contains sodium carbonate and sodium sulphide.

3. A process according to claim 2 wherein said oxysulphur component in i) comprises sodium sulphate and said sodium sulphate is reduced in ii) to sodium sulphide.

4. A process according to claim 1, wherein said reducing in ii) is carried out at low partial pressures of carbon dioxide and water.

5. A process according to claim 1, wherein said black liquor is oxidized prior to said pyrolyzing to oxidize lower oxygen state oxysulphur compounds to sulphate.

6. A process according to claim 1, wherein said reducing is carried out with addition of carbon monoxide to suppress sodium emission.

7. A process according to claim 1, wherein said cooling in iii) is carried out under heat exchange conditions and heat energy derived from said cooling is recovered.

8. A process according to claim 1, wherein said black liquor has a solids content of 60 to 100% by weight.

9. A process according to claim 1, wherein said pyrolyzing is carried out in a fluid bed.

10. A process according to claim 1 further including recovering volatile components from the pyrolyzing in i) and the reducing in ii), combusting said volatile components and recovering heat energy of combustion.

11. A process according to claim 10 wherein said combusting is carried out in a fluid bed reactor.

12. A process according to claim 11 wherein the fluid bed of said fluid bed reactor comprises particles of sodium carbonate and sodium sulphate.

13. A process according to claim 12 further including recovering a leached char from iv) and passing said leached char to said fluid bed in said fluid bed reactor.

14. A process according to claim 13 including dewatering said leached char from iv) prior to passage thereof to said fluid bed reactor to form an aqueous component and a residual char and feeding the aqueous component to said green liquor.

15. A process for the treatment of kraft black liquor to recover pulping chemicals and heat energy comprising:

a) pyrolyzing kraft black liquor containing sodium sulphate and sodium carbonate and having a solids content of 30 to 100% by weight, at a temperature up to 600° C. to produce a char containing carbon and said sodium sulphate and sodium carbonate, b) reducing said sodium sulphate to sodium sulphide with said carbon in said char under a low partial pressure of water and carbon dioxide at a temperature of about 750° C.

c) cooling the char from b) under heat exchange conditions and recovering the heat energy, d) leaching the cooled char from c) with water to form an aqueous extract containing sodium carbonate and sodium sulphide from said reduced char, and a leached char, e) recovering said aqueous extract as a green liquor, f) introducing said leached char from d) into a fluid bed, and g) recovering volatiles from steps a) and b), combusting said volatiles in said fluid bed in f), and recovering heat energy of the combustion.

16. A process according to claim 15 wherein the recovered heat energy from c) and f) is exploited to generate steam.

17. A process according to claim 15 wherein said reducing b) is carried out in an atmosphere generated by the reduction.

18. A process according to claim 15 wherein said fluid bed in f) consists essentially of a mixture of sodium carbonate and sodium sulphate particles.

19. A process according to claim 15 including removing excess particles from said fluid bed in f) and introducing the excess particles into a strong black liquor feed.

20. A process according to claim 18 including removing excess particles from said fluid bed in f) and introducing the excess particles into a strong black liquor feed.

* * * * *

UNITED STATES PATENT AND TRADEMARK OFFICE

CERTIFICATE OF CORRECTION

PATENT NO. : 5,174,860

DATED : December 29, 1992

INVENTOR(S) : Adriaan R. P. van Heiningen et al

It is certified that error appears in the above-identified patent and that said Letters Patent is hereby corrected as shown below:

On title page, item [73]
add the following: --Pulp and Paper Research Institute of Canada, Pointe Claire, Canada--

Column 7, line 35, between "under" and "helium" insert ... 90% ... .

Signed and Sealed this

Twenty-second Day of March, 1994

Bruce Lehman

*Attest:*

BRUCE LEHMAN

*Attesting Officer*

*Commissioner of Patents and Trademarks*